United States Patent [19]

Hargreaves et al.

[11] Patent Number: 4,994,175

[45] Date of Patent: Feb. 19, 1991

[54] SYNCRUDE DEDUSTING EXTRACTION

[75] Inventors: Jay T. Hargreaves, Elburn; James L. Taylor, Naperville, both of Ill.

[73] Assignee: Amoco Corporation, Chicago, Ill.

[21] Appl. No.: 284,181

[22] Filed: Dec. 14, 1988

[51] Int. Cl.[5] ..... C10G 1/00

[52] U.S. Cl. ..... 208/424; 208/425

[58] Field of Search ..... 208/424, 425

[56] References Cited

U.S. PATENT DOCUMENTS

| | | | |
|---|---|---|---|
| 3,661,774 | 5/1972 | Masologites | 208/424 X |
| 4,077,881 | 3/1978 | Snell | 208/424 X |
| 4,536,277 | 8/1985 | O'Grady et al. | 208/424 X |
| 4,544,477 | 10/1985 | Taylor | 208/424 |

*Primary Examiner*—Curtis R. Davis

*Attorney, Agent, or Firm*—Nick C. Kottis; William H. Magidson; Ralph C. Medhurst

[57] ABSTRACT

A method for dedusting synthetic oil is disclosed. A feed of dust-laden synthetic oil is dissolved in a non-polar solvent of at least one alkane containing from 4 to 7 carbon atoms and aggregates of dust material are formed. The dissolved dust-laden synthetic oil is then gravitationally separated into a substantially dedusted stream in a dust-enriched stream including aggregates formed in the dissolution step. The dissolution and gravitational separation steps are conducted at a temperature and pressure greater than about 150° F. and about ambient pressure and less than about the critical point temperature and pressure of the solvent and the aggregates provide acceptable settling and sludge compression rates. Methods for producing and dedusting oil from synthetic fuel stock are also disclosed.

44 Claims, 1 Drawing Sheet

SYNCRUDE DEDUSTING EXTRACTION

BACKGROUND OF THE INVENTION

This invention relates generally to synthetic fuels, and more particularly, to a process for producing and dedusting oil derived from oil shale, tar sands, and other solid carbon-containing materials.

In view of the recent instability of the price of and the open access to crude oil, researchers have renewed their efforts to find alternative sources of energy and hydrocarbons. Much of this research has focused on recovering hydrocarbons from solid hydrocarbon-containing materials such as oil shale, coal and tar sands, such as by pyrolysis or gasification to convert the solid hydrocarbon-containing material recovered therefrom into more readily useable gaseous and liquid hydrocarbons. Typically, synthetic oils, e.g., shale oil, tar sands bitumen, tar sands oil, heavy oils or the like, are produced by one of a variety of techniques including in situ, modified in situ and aboveground retorting processes or by hydrocarbon derivation from the inorganic/mineral components of these solid hydrocarbon-containing resources rock material such as through solvent extraction, for example. Consequently, these synthetic oils typically contain finely divided inorganic solids (called dust). The removal of such solids from the oil (called dedusting) greatly facilitates the transportation, refining and use of these oils.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah and Wyoming. The majority of the remainder of the United States' oil shale deposits is contained in the leaner Devonian-Mississippian black shale deposits which underlie much of the eastern part of the United States.

Shale oil is not a naturally occurring product, but is formed, for example, by the pyrolysis of the kerogen in oil shale. Crude shale oil, sometimes referred to as "retort oil," is the liquid oil product recovered from the liberated effluent of an oil shale retort. The upgraded product of shale oil is often referred to as "syncrude."

Generally, oil shale is a fine-grained sedimentary rock stratified in horizontal layers with a variable richness of kerogen content. Kerogen only has limited solubility in ordinary solvents and therefore generally cannot be efficiently converted to oil by solvent extraction alone. In contrast, in pyrolysis upon heating the oil shale to a sufficiently high temperature, the kerogen or a major portion thereof thermally decomposes to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. In such processing, however, a carbon residue typically remains on the retorted shale, thereby resulting in the loss of some of the valuable carbon content of the oil shale.

As a result of dwindling supplies of readily accessible and commercially useable petroleum and natural gas, extensive efforts have been directed to developing retorting processes which will economically produce shale oil on a commercial basis from these vast resources.

The process of pyrolyzing kerogen contained in oil shale to form liberated hydrocarbons (known as retorting) can be done aboveground in vessels known as surface retorts or underground in in situ retorts. In principle, the retorting of shale and other hydrocarbon-containing materials, such as coal and tar sands, comprises heating the solid hydrocarbon-containing material to an elevated temperature and recovering vapors and liberated effluent therefrom. However, as medium grade oil shale yields approximately 20 to 25 gallons of oil per ton of shale, for example, the expense associated with materials handling is critical to the economic feasibility of any such proposed commercial shale retorting operations.

In surface retorting, oil shale is mined from the ground, brought to the surface, crushed and placed in a vessel (a "retort") wherein the oil shale is contacted with a hot solid heat carrier material, such as hot spent shale, ceramic balls, metal balls, or sand, for example, or a gaseous heat carrier material, such as light hydrocarbon gases, to allow for the transfer of heat to the raw oil shale. The resulting high temperatures in the retort cause shale oil to be liberated from the oil shale leaving a retorted, inorganic material and a carbonaceous material, such as coke. The carbonaceous material can be burned by contact with oxygen at oxidation temperatures to recover heat and to form a spent oil shale which is relatively free of carbon. Spent oil shale which has been depleted in carbonaceous material can be discarded or, if desired, removed from the retort and recycled as heat carrier material. The liberated hydrocarbons and combustion gases can, in turn, be dedusted in gas-solid separation systems such as in cyclones, e.g., such as shown in U.S. Pat. Nos. 3,252,886; 3,784,462; and 4,101,412, electrostatic precipitators, filters, scrubbers, and granular bed filters, for example.

Generally, decrepitation of oil shale accompanies the retorting thereof as retorting results in the decomposition of a large portion of the kerogen content of the shale largely leaving behind the fine grain inorganics of the sedimentary shale. Consequently, during the retorting of oil shale, substantial quantities of minute shale particles become entrained in the shale oil so produced.

In addition, the use of hot spent shale as a heat carrier material can result in increased dust formation and thus aggravate the dust problem. Generally, rapid retorting is desirable to minimize thermal cracking of valuable condensable hydrocarbons. Shale dust is also emitted and carried away with the effluent product stream during modified in situ retorting as a flame front passes through a fixed bed of rubblized shale, as well as in fixed bed surface retorting, but dust emission is not as aggravated as in surface retorting.

Shale dust ranges in size from less than 1 micron to 1000 microns and is entrained and carried away with the effluent product stream. Generally, because shale dust has such small dimensions, much of it cannot be effectively removed to commercially acceptable levels with conventional dedusting equipment, such as cyclones, centrifuges or filters.

The retorting, carbonization or gasification of coal, peat and lignite and the retorting or extraction of tar sands, gilsonite, and oil-containing diatomaceous earth create similar dust problems.

After retorting, the effluent product stream of liberated hydrocarbons and entrained dust is withdrawn from the retort through overhead lines and subsequently conveyed to a separator, such as a single or multiple stage distillation column, quench tower, scrubbing cooler or condenser, where it can be separated into fractions of light gases, light oils, middle oils and heavy oils with the bottom, heavy oil fraction containing essentially all of the dust. Typically, as much as 65% by weight of the bottom, heavy oil fraction may consist of dust.

It is very desirable to upgrade the bottom, heavy oil into a more marketable light oil, but because the heavy oil fraction is laden with dust it is very viscous and cannot easily be piped through transport lines. Dust-laden heavy oil plugs up hydrotreaters and catalytic crackers, abrades valves, heat exchangers, outlet orifices, pumps and distillation towers, builds up insulative layers on heat exchange surfaces reducing their efficiency and fouls up other equipment. Furthermore, dusty heavy oil erodes turbine blades and creates emission problems. Moreover, dusty heavy oil generally cannot be refined with conventional equipment.

Efforts directed to resolving such dust problems have included the use of electrostatic precipitators and cyclones, located both inside and outside the retort. Electrostatic precipitators and cyclones, however, must be operated as high temperatures and the product stream must be maintained at approximately the temperature attained during the retorting process to prevent condensation and accumulation of dust on processing equipment. Maintaining the effluent stream at these high temperatures may favor detrimental side reactions, such as cracking, coking and polymerization of the effluent product stream, which tend to decrease the yield and quantity of condensable hydrocarbons.

Over the years various processes and equipment have been suggested to decrease the dust concentration in the heavy oil fraction and/or upgrade the heavy oil into more marketable light oils and medium oils. Such prior art dedusting processes and equipment have included the use of cyclones, electrostatic precipitators, pebble beds, scrubbers, filters, electric treaters, spiral tubes, ebullated bed catalytic hydrotreaters, desalters, autoclave settling zones, sedimentation, gravity settling, percolation, hydrocloning, magnetic separation, electrical precipitation, stripping and binding, as well as the use of diluents, solvents and chemical additives before centrifuging. Typifying those prior art processes and equipment and related processes and equipment are those found in U.S. Pat. Nos. 1,668,898; 1,687,763; 1,702,192; 1,707,759; 1,788,515; 2,235,639; 2,524,859; 2,717,865; 2,719,114; 2,723,951; 2,793,104; 2,879,224; 2,899,736; 2,904,499; 2,911,349; 2,952,620; 2,968,603; 2,982,701; 3,008,894; 3,034,979; 3,058,903; 3,252,886; 3,255,104; 3,468,789; 3,560,369; 3,684,699; 3,703,442; 3,784,462; 3,799,855; 3,808,120; 3,900,389; 3,901,791; 3,910,834; 3,929,625; 3,951,771; 3,974,073; 3,990,885; 4,028,222; 4,040,958; 4,049,540; 4,057,490; 4,069,133; 4,080,285; 4,088,567; 4,105,536; 4,151,067; 4,151,073; 4,158,622; 4,159,959; 4,162,965; 4,166,441; 4,182,672; 4,199,432; 4,220,522; 4,226,699; 4,246,093; 4,293,401; 4,324,651; 4,354,856; and 4,388,179 as well as in the articles by Rammler, R. W., *The Retorting of Coal, Oil Shale and Tar Sand By Means of Circulated Fine-Grained Heat Carriers as a Preliminary Stage in the Production of Synthetic Crude Oil*, Volume 65, Number 4, Quarterly of the Colorado School of Mines, pages 141-167 (October 1970) and Schmalfeld, I. P., *The Use of The Lurge/Ruhrgas Process For The Distillation of Oil Shale*, Volume 70, Number 3, Quarterly of the Colorado School of Mines, pages 129-145 (July 1975).

In addition, solvent dedusting processes wherein a dusty shale oil stream is mixed with a solvent or multi-component solvent and solids settle out of the stream have found only limited success as the rate of solids settling and cost of solvent recovery have restricted the use of these processes.

U.S. Pat. Nos. 4,572,777 and 4,584,087, assigned to Standard Oil Company (Indiana), relate to methods for recovering bitumen from a carbonaceous feed and for recovering a carbonaceous liquid from a fines-containing carbonaceous liquid feed by extraction of the feed with a solvent having a predetermined solvency power. These methods involve the selection and use of a solvent having a predetermined solvency power so as to dissolve a predetermined portion of either (1) the bitumen content of the carbonaceous feed or (2) the carbonaceous liquid feed, and to leave undissolved a sufficient portion of the bitumen or other carbonaceous liquid to settle out from the solvent-dissolved bitumen phase or solvent-dissolved carbonaceous liquid phase. U.S. Pat. No. 4,699,709, assigned to Amoco Corporation, discloses a method for removing solid fines in an extraction of bitumen by extracting bitumen with a mixed solvent comprising at least one solvent with a solubility parameter higher than that of the bitumen and at least one solvent with a solubility parameter lower than that of the bitumen to obtain a bitumen laden solvent mixture which is treated to remove the lower solubility parameter solvent, precipitating undissolved asphaltenic bitumen and solid fines.

In these methods, the agglomerated fines settling rate can be adjusted by altering the solvent selected or, in a multi-component solvent system, manipulating the relative proportions of the solvent. Agglomerated fines settling rates of up to about 1 foot per hour are shown.

The use of non-polar solvents, such as alkanes containing from 3 to 9 carbon atoms, in such processes generally suffers as these solvents typically result in the process having relatively low fines settling rates and sludge compression rates. Further, the use of polar solvents, such as methanol, in such processes typically results in the requirement of substantially greater relative amounts of heat addition for recovery in reuse of the valuable polar solvents as the polar solvents typically have comparatively high heats of vaporization, e.g., methanol has a heat of vaporization of about 3 times that of hexane.

U.S. Pat. No. 4,180,456 discloses a process for recovering a premium oil from a slurry produced by high temperature hydrogenation of a solid, hydrocarbonaceous fuel, such as coal. Such premium oils contain a large amount of asphaltenes and 1000+° F. material in contrast to retort solids which, for example, typically contain no more than about 1 to 3 weight percent asphaltenes.

In the process disclosed therein, a feed slurry resulting from high temperature hydrogenation of the solid feed is contacted with a nonpolar solvent, preferably a hydrocarbon and, more preferably, a $C_5$–$C_9$ aliphatic or alicyclic hydrocarbon or naphthenic or paraffinic fraction of a coal liquefaction product containing less than 10 wt. % aromatics. Thus, no distinction is made between aliphatic and alicyclic hydrocarbon solvents. A solvent:slurry weight ratio between 0.5:1 and 5:1, with a preferred maximum weight ratio of about 1:1 and an especially preferred weight ratio of 0.8:1 are disclosed.

Further, the '456 patent points to the criticality of the Marangoni effect in the effective extraction of the feed slurry and in the selection of a solvent to obtain proper operation of the process (Example 6). Thus, dispersion formation is a critical factor in solvent selection for the process disclosed in the '456 patent as opposed to the selection of solvents and operating conditions to obtain desired settling rates to permit the effective and efficient operation of the dedusting operation.

These prior art processes and equipment have not been universally successful in economically decreasing dust concentrations in such heavy oil fractions to acceptable levels.

SUMMARY OF THE INVENTION

It is the object of the present invention to overcome one or more of the problems described above.

According to the invention, a method for producing and dedusting synthetic oil from oil shale, tar sands and other solid hydrocarbon-containing materials is provided. Advantageously, the dedusted oil can be safely piped through valves, outlet orifices, pumps, heat exchangers and distillation columns and can be refined in hydrotreaters and catalytic crackers.

The oil can be produced underground in modified or true in situ retorts, or can be produced aboveground in surface retorts or in solvent extraction vessels. In a preferred form, the oil is produced in a surface retort by mixing raw oil shale or other solid hydrocarbon-containing material in a retort with solid heat carrier material to liberate an effluent product stream of hydrocarbons, which stream typically contains entrained particles of dust. The surface retort can be a static mixer retort, a gravity flow retort, a fluid bed retort, a screw conveyor retort, a rotating pyrolysis drum retort or other suitable retort, for example.

In one preferred form, the effluent product stream of hydrocarbons is partially dedusted in at least one gas-solid separation device, such as a cyclone, before being fed to at least one separator such as a fractionator, a scrubber or a quench tower, for example, where it is separated into one or more fractions of normal liquid oil. For reasons of economy and dedusting efficiency, it is preferred to separate a significant portion of the dust in the bottom fraction of heavy oil. Dust is efficiently concentrated in the heavy oil fraction through distillation. In a preferred embodiment, the heavy oil fraction contains from about 1 percent to about 65 percent by weight of the dust.

The dust-laden oil is efficiently, economically and effectively dedusted by dissolving the dust-laden oil fraction in a non-polar solvent comprising at least one alkane containing from 4 to 7 carbon atoms and thereby forming aggregates comprising a substantial portion of the dust. The dust-laden oil mixture can then be gravitationally separated into a substantially dedusted stream and a dust-enriched stream which contains a substantial portion of the aggregates formed during dissolution and aggregate formation. These aggregates provide acceptable settling and sludge compression rates during the separation. Further, the dissolution and gravitational separation steps are conducted at a temperature and pressure greater than about 150° F. and about the ambient pressure and less than the critical point temperature and pressure of the non-polar solvent.

As used in this application, the term "dust" means particulates derived from solid hydrocarbon-containing materials. The particulates range in size from less than 1 micron to 1000 microns and include retorted and raw unretorted hydrocarbon-containing material, as well as spent hydrocarbon-containing material and may also include particles of solid heat carrier material used during retorting such as sand or cracking catalyst, for example. Dust derived from retorting of oil shale consists primarily of clays, calcium and magnesium oxides, carbonates, silicates and silicas. Dust derived from the retorting or extraction of tar sands consists primarily of silicates, silicas and carbonates.

The terms "retorted" hydrocarbon-containing material and "retorted" shale as used in this application refer to hydrocarbon-containing material and oil shale respectively, which have been retorted to liberate hydrocarbons leaving an inorganic material containing carbon residue.

The terms "spent" hydrocarbon-containing material and "spent" oil shale as used herein mean retorted hydrocarbon-containing material and oil shale, respectively, from which most of the carbon residue has been removed by combustion.

The term "synthetic oil" as used herein means oil which has been produced from solid hydrocarbon-containing material. The synthetic oil in the present process is dedusted according to the principles of the present invention before being upgraded, such as in a hydrotreater, hydrocracker, or catalytic cracker.

The terms "dust-laden" and "dusty" synthetic oil as used herein mean synthetic oil which contains a substantial amount of entrained particulates of dust.

The term "polar" solvent as used herein means a solvent that tends to interact with other compounds or itself through acid-base interactions, hydrogen bonding, dipole-dipole interactions, or by dipole-induced dipole interactions.

The term "non-polar" solvent as used herein means a solvent that is not a polar solvent. Non-polar solvents interact with other compounds or themselves predominantly through dispersion forces. Non-polar solvents interact with polar solvents mainly through dipole-induced dipole interactions or through dispersion forces. Nonpolar solvents in the subject dedusting process can also include weakly polar solvents.

The terms "normally liquid," "normally gaseous," "condensible," "condensed," and "noncondensible" are relative to the condition of the subject material at a temperature of 77° F. (25° C.) and at atmospheric pressure.

The term "sludge" as used herein refers to a stream or mass of material containing at least about 10 weight percent solids.

Other objects and advantages of the invention will be apparent to those skilled in the art from the following detailed description, taken into conjunction with the appended claims and drawings.

DETAILED DESCRIPTION OF THE INVENTION

Figure 1:
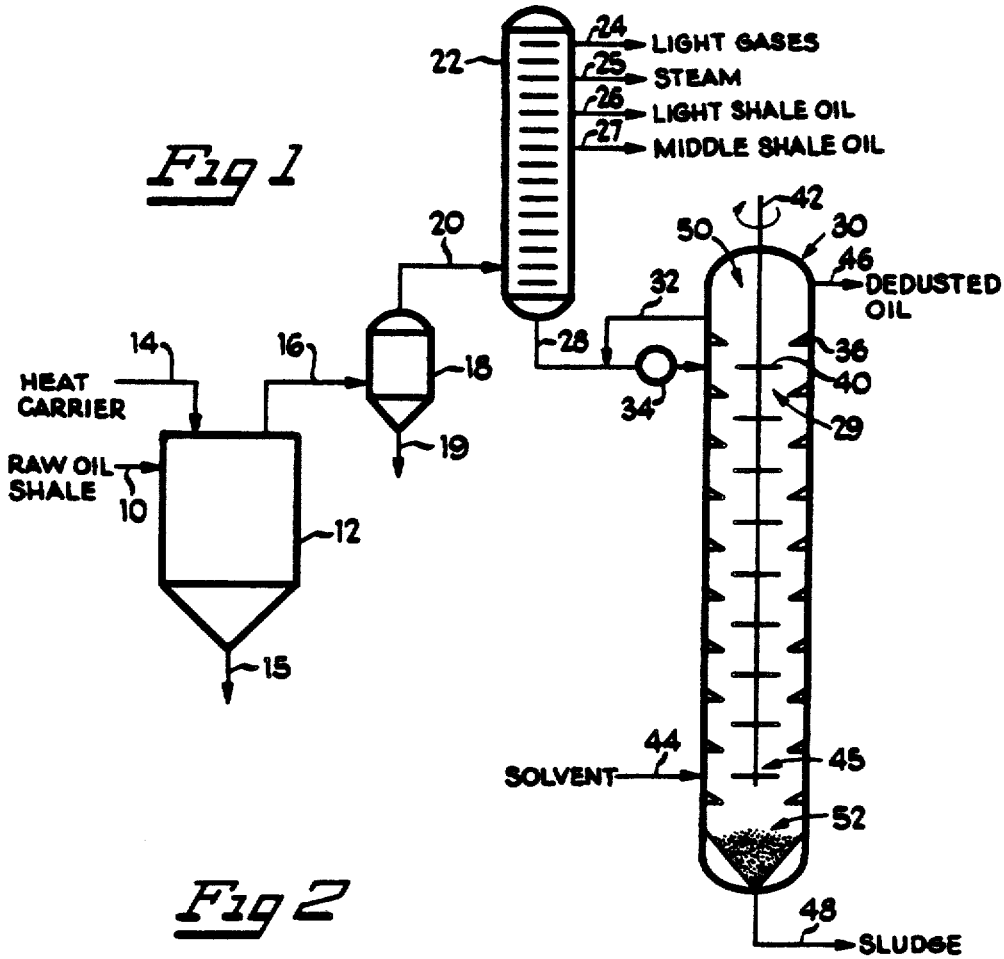
FIG. 1 is a simplified schematic diagram of a system for producing and dedusting synthetic oil according to a typical embodiment of the present invention.

Referring to FIG. 1, a process and system is provided to produce and dedust synthetic oil from a solid hydrocarbon-containing material, such as oil shale, tar sands, unitate (gilsonite), lignite, peat, and oil-containing diatomaceous earth (diatomite), for example. While the present invention is described hereinafter with particular reference to the processing of oil shale (producing shale oil) and a particular fraction thereof, i.e., heavy shale oil (e.g., the 650° F.+boiling fraction of shale oil), it will be apparent that the process and system can also be used in connection with the processing of other hydrocarbon-containing materials; such as tar sands (e.g., producing tar sands oil and/or tar sands bitumen), unitate (gilsonite), oil-containing diatomaceous earth, etc.; alternative fractions of oil shale or complete oil shale samples (unfractionated samples). It is to be understood, however, that the amount of solvent required in the practice of the invention will be largely dependent on the amount of material to be dedusted and thus some form of pretreatment or fractionation whereby particular fractions to be treated are separated from the remainder of the sample may be preferred.

Raw, fresh oil shale, which preferably contains an oil yield of at least 15 gallons per ton of shale particles, is crushed and sized to a maximum fluidizable size of about 3 mm. The fresh oil shale can be crushed by conventional crushing equipment, such as an impact crusher, jaw crusher, gyratory crusher, roll crusher, and subsequently screened with conventional screening equipment, such as a shaker screen or a vibrating screen, for example. The crushed and sized raw, fresh oil shale is fed through a raw shale inlet line 10 at a temperature in the range of from about ambient temperature to about 600° F. into an aboveground surface retort 12. The retort can be a gravity flow retort, a static mixer retort with a surge bin, a fluid bed retort, a rotating pyrolysis drum retort with an accumulator having a rotating trommel screen, a screw conveyor retort with a surge bin or other retort device.

Spent (combusted) oil shale, cracking catalysts, mixtures thereof or other solid heat carrier material is fed through a heat carrier line 14 at a temperature from about 1000° F. to about 1400° F., preferably from about 1200° F. to about 1300° F., into the retort 12 to mix with, heat and retort the raw oil shale. The temperature of the retort is from about 850° F. to about 1100° F., preferably from about 900° F. to about 1000° F., near atmospheric pressure and is sufficient whereby the retort liberates an effluent stream of hydrocarbons and entrained particles of dust. Air and molecular oxygen are preferably prevented from entering the retort in order to prevent combustion of the oil shale, shale oil and liberated gases in the retort.

In a fluid (fluidized) bed retort, inert fluidizing lift gas, such as a light hydrocarbon gas, is injected into the bottom of the retort through a gas injector to fluidize, entrain and enhance the mixing of the raw oil shale with the solid heat carrier material in the retort. Other types of retorts, such as a fixed bed retort, a rock pump retort, or a rotating grate retort, can, if desired, be used with a gaseous heat carrier material in lieu of a solid heat carrier material.

During retorting, hydrocarbons and steam are liberated from the raw oil shale as gas, vapor, mist or liquid droplets and most likely a mixture thereof along with entrained particulates of oil shale (dust) ranging in size from less than 1 micron to 1000 microns. Retorted and spent oil shale particles from the retort 12 are discharged through a line 15 by gravity flow or other conveying means and may, with appropriate treatment or conditioning (e.g., substantially completing combustion thereof), be returned to the retort 12 as a heat carrier. An effluent product stream of hydrocarbons and steam liberated during retorting are withdrawn from the upper portion of the retort through an overhead product line 16 and passed to one or more internal or external gas-solid separating devices 18, such as a cyclone, a filter or the like. The gas-solid separating device 18 partially dedusts the effluent product stream, with shale dust removed from the product stream being discharged through a dust outlet line 19 from the gas-solid separating device 18. The partially dedusted stream exits the gas-solid separating device 18 through a transport line 20 where it is transported to one or more separators 22, such as quench towers, scrubbers or fractionators, also referred to as fractionating columns or distillation columns.

In the separator 22, the partially dedusted effluent product stream is separated into fractions of light hydrocarbon gases, steam, light shale oil, middle shale oil, and heavy shale oil. These fractions are discharged from the separator through lines 24–28, respectively. Typically, heavy shale oil has an initial boiling point between about 650° F. and 850° F. and an end point, which includes the heaviest material in the oil, of up to about 1100° F. Further, middle shale oil typically has an initial boiling point of about 400° F. and light shale oil typically has an initial boiling point of about 100° F.

The solids bottom heavy shale oil fraction in the bottom separator line 28 is a slurry of dust-laden heavy shale oil that contains from about 15% to about 45% by weight of the effluent product stream. The dust-laden heavy oil, which is also referred to as "dusty oil," includes normally liquid heavy shale oil and from about 1% to about 65%, by weight entrained particulates of oil shale dust, and preferably, for reasons of dedusting efficiency and economy, at least about 25% by weight oil shale dust. Generally, the oil shale dust is mainly minute particles of spent oil shale and lesser amounts of retorted and/or raw oil shale particulates. The temperature in the separator can be varied from about 500° F. to about 800° F., and preferably is maintained at about 600° F., at atmospheric pressure and controlled to assure that essentially all of the oil shale dust gravitates to and is entrained in the solids bottom heavy oil fraction. The dust-laden heavy oil typically has an API gravity from 5° to 20° and a mean average boiling point from 600° F. to 950° F.

The dusty heavy shale oil in the bottom separator line 28 is fed to the top portion 29 of an extraction column 30. To obtain superior dispersion of the dust and a high degree of oil extraction, the dusty heavy shale oil is mixed with a recycle stream 32 containing shale oil and solvent by means of a mixing device 34, preferably a static mixer.

A dusty dispersion descends in the column 30 while oil is continuously and countercurrently extracted from the dispersion. Good dispersion of the dust, and hence, effective extraction of the oil, is enhanced by the use of internals or other back mix prevention means within the column 30. The column internals used may be of a static type, such as coarse packing, or, if preferred, of a moving type. For example, the column 30, as shown, contains donut-shaped static plates 36 and rotating disks 40 attached to a central rotating shaft 42. In addition, the plates 36 may be inclined to prevent the settling of solids thereon. Also, the disks 40 may have inclined surfaces or perforations therethrough to prevent the accumulation of solids thereon. Also, if desired, the rotating disks 40 may have turbine blades or other devices attached thereto to enhance mixing and extraction of oil.

A solvent is fed via a line 44 near the bottom stage or portion 45 of the column 30. This solvent serves to extract oil from the dusty, heavy shale oil dispersion being treated in the column by dissolving the feed, e.g., the dust-laden shale oil, and forming dust material aggregates. The dissolved dust-laden synthetic oil, e.g., shale oil, is then gravitationally separated into a substantially dedusted stream 46 and a dust-enriched stream 48 comprising dust material aggregates, with the aggregates providing acceptable settling and sludge compression rates (as to be later described herein).

Typically, such a dissolution and separation process will preferably be conducted in countercurrent extraction devices, such as a countercurrent extraction column, for example. It is to be understood, however, that other processing apparatus, including other countercurrent extraction devices, such as mixer-settler stages, can be used in the practice of the invention and are provided for hereby.

Generally, it may be preferred that the solvent be at a different temperature than the dusty shale oil feed so as to maintain a temperature gradient within the column 30. More preferably, the temperature of the solvent is the same or up to about 100° F. more than that of the feed. Preferably, the solvent will be a hydrocarbon solvent with an average molecular weight of from about 56 to about 100 lb./mole, and will contain few alicyclic (naphthenic), heteroatomic or aromatic compounds. Typically, the solvent will include at least one alkane containing from 4 to 7 carbon atoms, with such an alkane being a predominate portion of the solvent. It is to be understood, however, that the solvent can, if desired, contain other components, such as alkenes, in comparatively minor proportions. Further, in accordance with one embodiment of the invention, the solvent is a process-derived solvent mixture comprising $C_4$–$C_7$ alkanes and alkenes. In the practice of the invention, such a process-derived solvent may be preferred, as it may result in processing and transportation costs savings, for example. The weight ratio of solvent to feed will generally be at least 1:1 as the dust/agglomerate settling rate decreases rather dramatically with decreased solvent to feed ratios. More specifically, the weight ratio of solvent to feed will be in the range of between about 1:1 to about 7:1, and preferably between about 2:1 and 4:1. As the solvent is displaced up the column 30, oil is extracted countercurrently from the descending dispersion of dust.

The temperature in the column will preferably be less than the critical point of the solvent fed via the line 44 and will generally average less than about 500° F. The temperature in the column will, however, generally be greater than about 150° F. and the atmospheric boiling point of the solvent and preferably no more than about 350° F. In addition, the column 30 will preferably be maintained at a pressure greater than the atmospheric boiling point of the solvent as to keep the solvent in a liquid form. Preferably the pressure is autogenous and above about 50 psi and less than 500 psi and the critical pressure of the solid, and more preferably less than 300 psi. In this range of temperatures, pressures and solvent-to-feed ratios, it is possible to obtain desired dust settling rates, e.g., dust aggregate settling rates of about 10–100 feet/hour, and more preferably about 20–50 feet/hour, as such settling rates assure sufficient dust agglomerate residence time to allow the benefits of countercurrent flow between the descending agglomerates and the ascending solvent to be more fully realized whereby increased oil extraction from the fines agglomerates is obtained.

As used in the practice of the invention, the countercurrent extraction column typically is designed to contain between about 1 ½ to about 4 theoretical stages, giving performance about equivalent to 2 to 4 countercurrent mixer-settler stages, where a theoretical stage corresponds to the height of column that provides mixing/settling performance corresponding to one mixer-settler stage.

A dedusted oil stream 46 is drawn from the top of the column 30. In addition, if desired, the column 30 may include or have added thereto a stagnant disengaging zone 50 to facilitate the removal of dust from the heavy shale oil and solvent. Thus, the substantially dedusted oil stream 46 contains less than about 1 weight percent dust on a solvent-free basis, about 10–30 weight percent oil and about 65–90 weight percent solvent.

In the illustrated embodiment the column 30 includes a stagnant compression zone 52 wherein a dusty sludge is thickened by the continued settling of the dust and expulsion of the solvent and oil. Consequently, the dust-enriched, sludge stream 48 is withdrawn from the bottom of the extraction column 30 and typically contains about 30–70 weight percent solids and more preferably more than about 40 weight percent solids. In addition, the sludge stream 48 will generally contain less than about 15 weight percent oil and preferably less than 8 weight percent oil. The balance of the sludge stream will typically comprise solvent.

If desired, the solvents in the sludge and the dedusted streams may be recovered and recycled to the extraction process. For example, the solvent may be recovered from the sludge using a fluid-bed dryer, an indirect rotary dryer, or a similar device. The residual oil in the sludge may be combusted in the retorting system to recover part of its heat value and/or to make the waste stream more environmentally acceptable. If desired, the solvent in the dedusted oil stream may be recovered by flashing, multiple effect vaporation or other known technologies for the removal of solvent efficiently, effectively, and economically.

In this invention, the dust-laden oil is efficiently, economically and effectively dedusted by dissolving the dusty oil in a hydrocarbon solvent having an average molecular weight between about 56 and about 100 lb./mole, having little aromatic or alicyclic character, containing few heteroatoms such as nitrogen, sulphur or oxygen, and preferably containing predominantly normal paraffins. The dissolved oil is separated into a substantially dedusted stream and a dust-enriched stream (called a sludge) using a countercurrent extraction device, preferably a single column. The mixture of solvent, oil and dust is held under sufficient pressure to prevent the evaporation of the solvent, but below the critical point of the solvent. The temperature is maintained so that the settling rate of the dust between the upper part of the column where the dusty oil is fed and the lower part of the column where the sludge is withdrawn, averages between about 10–100 feet/hour, and preferably between about 20–50 feet/hour.

For settling rates much above 100 feet/hour, the settling is so rapid that effective multi-stage separation of the oil from the dust cannot be obtained in conventional countercurrent extraction columns. For settling rates below 10 feet/hour, the inventory of solvent required generally, necessitates the use of countercurrent contactors with dimensions so large as to be impractical. Thus, settling rates in the range of between about 10–100 feet/hour are preferred if highly efficient and effective countercurrent extraction columns are to be used.

Very high settling rates for the dust, e.g., in excess of 100 feet/hour, are obtainable by dedusting at or near the critical temperature of the solvent. In contrast, dedusting at temperatures below the atmospheric boiling point of a hydrocarbon solvent generally results in settling rates of only a few feet/hour.

Figure 2:
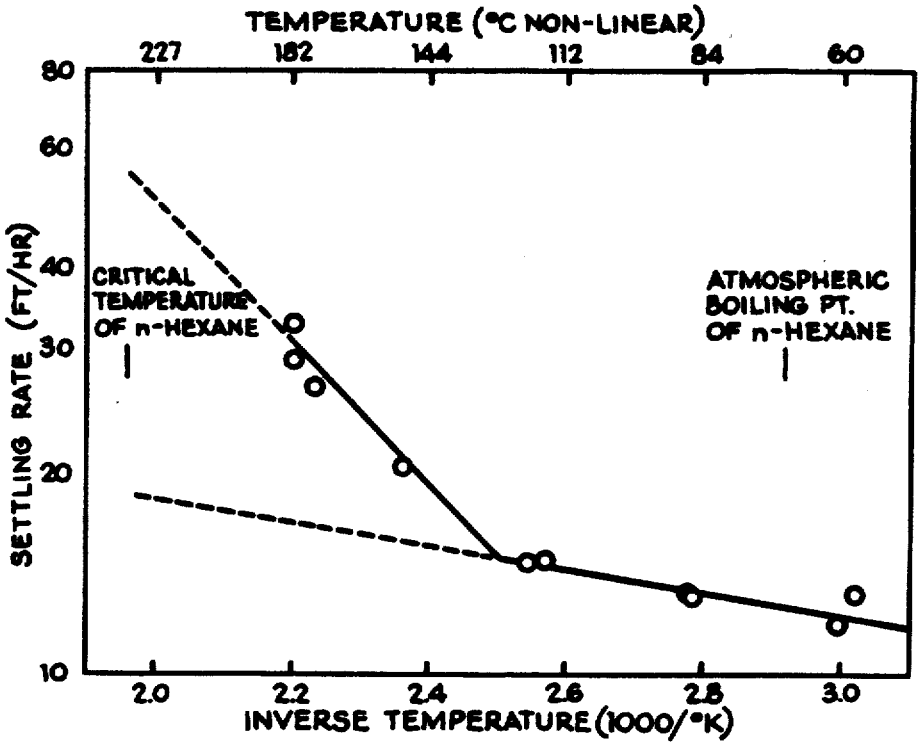
FIG. 2 is a plot of the settling rate of dust in hexane and heavy shale oil under autogenous pressure wherein the hexane and dusty shale oil are in a ratio of 3 weight hexane: 1 weight dusty shale oil (wherein the shale oil contains 44 weight percent dust), with settling rate versus inverse temperature.

Referring to FIG. 2, which presents graphical data with respect to the settling rate of dust in n-hexane and heavy shale oil under autogenous pressure, wherein the hexane and dusty shale oil are in a ratio of 3 weight hexane: 1 weight dusty shale oil (wherein the shale oil contains 44 weight percent dust) extrapolation of settling rate versus temperature around the atmosphere boiling point of the solvent would indicate that the settling rate would only increase slightly with temperature up to the critical point of the solvent. However, it has been discovered that the settling rate begins to increase rapidly above the atmospheric boiling point of the solvent but well below the solvent's critical point. Further, it has been determined that the break-point temperature, e.g., the temperature at which a rapid increase in settling rate begins, is characteristic of the shale oil and not the solvent used. Thus, typical break-point temperatures for heavy shale oil generally range between about 200° F. and 300° F. Further, settling rates in the desired dust settling range of between about 10 feet/hour and 100 feet/hour for effective column extraction, are obtained with hydrocarbon solvents which contain few alicyclic or aromatic compounds and few heteroatoms and have molecular weight averages between about 56–100 lb./mole as opposed to typical polar solvents such as low molecular weight alcohols, ketones or carboxylic acids, such as methanol, acetone and acetic acid, respectively, for example. These operating criteria result in a preferred operating pressure for dedusting of above atmospheric conditions but well below the solvent critical point pressure at which point costly, high pressure equipment is typically required. To obtain these desired settling rates, a ratio of solvent to dusty oil in excess of 5:1 can be used with a ratio in the range of between about 1:1 to about 7:1 being generally preferred and with a ratio in the range of between about 2:1 to about 4:1 being more preferred.

Further, in the extremes of high and low settling rates, countercurrent extraction columns are not preferred for dedusting by solvent extraction and in their place stages of mixtures and settlers may be used.

Countercurrent extraction columns, besides generally being an economically preferred alternative for solvent extraction processes, provide the additional benefit of necessitating that the dusty sludge settle and compress only once, whereas stages of mixtures and settlers typically require several compression and redispersions of the sludge. The rate of sludge compression can strongly affect the size of the extraction hardware and the inventory of solvent that must be maintained. Generally, sludge compression rates of at least 0.2 feet/hour are commercially acceptable, with higher compression rates being more preferred. A further benefit of the practice of the present invention is that sludge compression rates of above about 1 foot/hour are generally obtainable.

While the invention has been described above with particular reference to the processing of oil shale and as having applicability to the processing of solid, hydrocarbon-containing materials, the invention has been found to have particular utility in the processing and dedusting of retorted oils, such as shale oil and tar sands oil obtained from bitumen, for example. It being understood that the solids contained in retort feeds and that are carried over in the retort product stream are largely inorganic and that retort feeds typically contain no more than about 1 to 3 weight percent asphaltenes as opposed to the solids derived from feeds, such as coal, in processing, such as high temperature hydrogenation, which feeds typically contain significant proportions of organic solids, e.g., about 30–50 weight percent of the solids are organic, and which feeds have significantly higher asphaltene contents, e.g., coal liquids, for example, have an asphaltene content typically of at least about 10 weight percent and sometimes exceeding 30 weight percent.

The foregoing detailed description is given for clearness of understanding only, and no unnecessary limitations are to be understood therefrom, as modifications within the scope of the invention will be obvious to those skilled in the art.

What is claimed:

1. A method for dedusting synthetic oil, said method comprising the steps of:

(a) substantially dissolving a feed comprising a dust-laden synthetic oil selected from the group consisting of shale oil, tar sands oil and tar sands bitumen in a non-polar solvent comprising at least one alkane containing from 4 to 7 carbon atoms and forming aggregates comprising dust material; and (b) gravitationally separating the dissolved dust-laden synthetic oil into a substantially dedusted stream and a dust-enriched stream comprising aggregates formed in step (a), said aggregates providing acceptable settling and sludge compression rates;

said dissolution and gravitational separation steps being conducted at a temperature and pressure greater than about 150° F. and about ambient pressure and less than about the critical point temperature and pressure of said solvent.

2. The method of claim 1 wherein said dissolution and separation steps are effected in countercurrent extraction means wherein said dust-laden synthetic oil and said non-polar solvent countercurrently contact each other.

3. The method of claim 2 wherein said countercurrent extraction means comprise a countercurrent extraction column wherein said dust-laden synthetic oil enters in the top portion of said column and said non-polar solvent enters in the bottom portion of said column.

4. The method of claim 3 wherein said countercurrent extraction column comprises back mix prevention means.

5. The method of claim 4 wherein said column comprises a rotating disc column.

6. The method of claim 3 wherein said column comprises in the range of about 1 ½ to about 4 theoretical stages.

7. The method of claim 1 wherein the temperature is in the range of from about the atmospheric boiling point of said non-polar solvent to about 350° F. and said pressure is less than about 300 psi.

8. The method of claim 1 wherein said aggregate settling rate is no more than about 100 feet/hour.

9. The method of claim 8 wherein said aggregate settling rate is about 20 feet/hour to about 50 feet/hour.

10. The method of claim 1 wherein said dissolution step comprises admixing said non-polar solvent and said feed in a weight ratio in the range of about 1:1 to about 7:1, solvent to feed.

11. The method of claim 10 wherein said non-polar solvent and said feed are admixed in a weight ratio in the range of about 2:1 to about 4:1, solvent to feed.

12. A method for producing and dedusting oil from synthetic fuel stock, said method comprising the steps of:

(a) retorting a solid hydrocarbon-containing material selected from the group consisting of oil shale and tar sands by mixing said solid hydrocarbon-containing material with a solid heat carrier material, selected from the group consisting of combusted solid hydrocarbon-containing material including spent shale, spent sand, cracking catalyst and mixtures thereof, in a retort at a sufficient retorting temperature to liberate an effluent product stream of hydrocarbons and entrained particles of dust selected from the group consisting of raw, retorted, and combusted solid hydrocarbon-containing materials and combinations thereof;

(b) separating a fraction of normally liquid oil from said effluent product stream, said fraction containing a substantial portion of said entrained particles;

(c) substantially dissolving said fraction in a non-polar solvent comprising at least one alkane containing from 4 to 7 carbon atoms and forming aggregates comprising dust particles; and (d) gravitationally separating the dissolved fraction into a substantially dedusted stream of solvent and oil containing a substantially lower concentration of dust particles containing aggregates than said fraction and a particulate-laden residual stream of solvent and oil having a substantially higher concentration of said dust particle containing aggregates than said fraction, said aggregates providing acceptable settling and sludge compression rates;

said dissolution and gravitational separation steps are being conducted at a temperature and pressure greater than about 150° F. and about ambient pressure and less than about the critical point temperature and pressure of said solvent.

13. The method of claim 12 wherein said retorting temperature is in the range of about 850° F. to about 1100° F.

14. The method of claim 13 wherein said retorting temperature is in the range of about 900° F. to about 1000° F.

15. The method of claim 12 wherein said dissolution and separation steps are effected in countercurrent extraction means wherein said dust-laden synthetic oil and said non-polar solvent countercurrently contact each other.

16. The method of claim 15 wherein said countercurrent extraction means comprise a countercurrent extraction column wherein said dust-laden synthetic oil enters in the top portion of said column and said non-polar solvent enters in the bottom portion of said column.

17. The method of claim 16 wherein said countercurrent extraction column comprises back mix prevention means.

18. The method of claim 17 wherein said column comprises a rotating disc column.

19. The method of claim 16 wherein said column comprises in the range of about 1 ½ to about 4 theoretical stages.

20. The method of claim 12 wherein the temperature is in the range of from about the atmospheric boiling point of said non-polar solvent to about 350° F. and said pressure is less than about 300 psi.

21. The method of claim 12 wherein said aggregate settling rate is no more than about 100 feet/hour.

22. The method of claim 21 wherein said aggregate settling rate is about 20 feet/hour to about 50 feet/hour.

23. The method of claim 12 wherein said dissolution step comprises admixing said non-polar solvent and said feed in a weight ratio in the range of about 1:1 to about 7:1, solvent to feed.

24. The method of claim 23 wherein said non-polar solvent and said feed are admixed in a weight ratio in the range of about 2:1 to about 4:1, solvent to feed.

25. A method for dedusting shale oil, said method comprising the steps of:

(a) substantially dissolving a feed comprising a dust-laden shale oil in a non-polar solvent comprising at least one alkane containing from 4 to 7 carbon atoms and forming aggregates comprising dust material; and (b) gravitationally separating the dissolved dust-laden shale oil into a substantially dedusted stream and a dust-enriched stream comprising aggregates formed in step (a), said aggregates providing acceptable settling and sludge compression rates;

said dissolution and gravitational separation steps being conducted at a temperature and pressure greater than about 150° F. and about ambient pressure and less than about the critical point temperature and pressure of said solvent.

26. The method of claim 25 wherein said dissolution and separation steps are effected in extraction means wherein said dust-laden synthetic oil and said non-polar solvent countercurrently contact each other.

27. The method of claim 26 wherein said countercurrent extraction means comprise a countercurrent extraction column wherein said dust-laden synthetic oil enters in the top portion of said column and said non-polar solvent enters in the bottom portion of said column.

28. The method of claim 25 wherein said aggregate settling rate is no more than about 100 feet/hour.

29. The method of claim 28 wherein said aggregate settling rate is about 20 feet/hour to about 50 feet/hour.

30. The method of claim 25 wherein said dissolution step comprises admixing said non-polar solvent and said feed in a weight ratio in the range of about 1:1 to about 7:1, solvent to feed.

31. The method of claim 30 wherein said non-polar solvent and said feed are admixed in a weight ratio in the range of about 2:1 to about 4:1, solvent to feed.

32. A method for producing and dedusting shale oil, said method comprising the steps of:

(a) retorting raw oil shale by contacting said raw oil shale with a solid heat carrier material comprising spent oil shale at a sufficient temperature to liberate an effluent product stream of hydrocarbons and entrained particulates of raw, retorted and combusted oil shale dust ranging in size from less than about 1 micron to about 1000 microns;

(b) partially dedusting said effluent product stream in at least one gas-solid separation device selected from the group consisting of a cyclone and a filter;

(c) separating a fraction of normally liquid shale oil containing from about 1% to 65% by weight of said shale dust in at least one separator selected from the group consisting of a fractionator, a scrubber, and a quench tower;

(d) substantially dissolving said fraction in a non-polar solvent comprising at least one alkane containing from 4 to 7 carbon atoms and forming aggregates comprising a substantial portion of said dust; and (e) gravitationally separating the dissolved fraction into a substantially dedusted stream and a dust-enriched stream comprising a substantial portion of said aggregates formed in said dissolution and aggregate formation step, said aggregates providing acceptable settling and sludge compression rates;

said dissolution and separation steps being conducted at a temperature and pressure greater than about 150° F. and about ambient pressure and less than about the critical point temperature and pressure of said solvent.

33. The method of claim 32 wherein said retorting temperature is in the range of at least about 850° F. to about 1100° F.

34. The method of claim 32 wherein said dissolution and separation steps are effected in countercurrent extraction means wherein said dust-laden synthetic oil and said non-polar solvent countercurrently contact each other.

35. The method of claim 34 wherein said countercurrent extraction means comprise a countercurrent extraction column wherein said dust-laden synthetic oil enters in the top portion of said column and said non-polar solvent enters in the bottom portion of said column.

36. The method of claim 32 wherein said aggregate settling rate is no more than about 100 feet/hour.

37. The method of claim 36 wherein said aggregate settling rate is about 20 feet/hour to about 50 feet/hour.

38. The method of claim 32 wherein said dissolution step comprises admixing said non-polar solvent and said feed in a weight ratio in the range of about 1:1 to about 7:1, solvent to feed.

39. The method of claim 38 wherein said non-polar solvent and said feed are admixed in a weight ratio in the range of about 2:1 to about 4:1, solvent to feed.

40. A method of dedusting a 650° F.+fraction of shale oil comprising about 1 weight percent to about 65 weight percent solids, said method comprising the steps of:

(a) substantially dissolving a feed comprising dust-laden 650° F.+fraction of shale oil in a non-polar solvent comprising at least one alkane containing from 4 to 7 carbon atoms and forming aggregates comprising dust material; and (b) gravitationally separating the dissolved dust-laden 650° F.+fraction of shale oil into a substantially dedusted stream and a dust-enriched stream comprising aggregates formed in step (a), said aggregates having a settling rate of about 20 feet/hour to about 50 feet/hour;

said dissolution and gravitational separation steps being conducted at a temperature and pressure greater than about 150° F. and about ambient pressure and less than about the critical point temperature and pressure of said solvent; and wherein said dissolution and separation steps are effected in a countercurrent extraction column wherein said dust-laden 650° F.+fraction shale oil and said non-polar solvent countercurrently contact each other with said dust-laden shale oil fraction entering in the top portion of said column and said non-polar solvent entering in the bottom portion of said column.

41. The method of claim 40 wherein said column comprises between about 1 ½ to about 4 theoretical stages.

42. The method of claim 40 wherein the temperature is in the range of from about the atmospheric boiling point of said non-polar solvent to about 350° F. and said pressure is less than about 300 psi.

43. The method of claim 40 wherein said dissolution step comprises admixing said non-polar solvent and said feed in a weight ratio in the range of about 1:1 to about 7:1, solvent to feed.

44. The method of claim 43 wherein said non-polar solvent and said feed are admixed in a weight ratio in the range of about 2:1 to about 4:1, solvent to feed.

* * * * *